United States Patent [19]

Spirov et al.

[11] Patent Number: 4,903,556

[45] Date of Patent: Feb. 27, 1990

[54] QUICK-ADJUSTING WRENCH

[75] Inventors: Predrag Spirov, Chicago, Ill.; Tom Masbaum, 5351 W. Giddings, Chicago, Ill. 60630

[73] Assignee: Tom Masbaum, Chicago, Ill.

[21] Appl. No.: 289,565

[22] Filed: Dec. 23, 1988

[51] Int. Cl.[4] ..... B25B 13/24

[52] U.S. Cl. ..... 81/149; 81/154

[58] Field of Search ..... 81/154, 148, 149, 150

[56] References Cited

U.S. PATENT DOCUMENTS

| | | | |
|---|---|---|---|
| 1,004,561 | 10/1911 | Fitzgerald . | |
| 1,389,487 | 8/1921 | Cassel | 81/154 |
| 1,397,214 | 11/1921 | Hose . | |
| 1,427,918 | 9/1922 | Stauffer . | |
| 1,481,250 | 1/1924 | Bohn et al. . | |
| 1,511,536 | 10/1924 | Strickler . | |
| 1,514,017 | 11/1924 | Schroeder . | |
| 2,948,175 | 8/1960 | Bonkowski | 81/154 |

FOREIGN PATENT DOCUMENTS

| | | |
|---|---|---|
| 143761 | 10/1951 | Australia . |
| 317696 | 6/1918 | Fed. Rep. of Germany . |
| 349590 | 3/1922 | Fed. Rep. of Germany . |
| 379745 | 8/1923 | Fed. Rep. of Germany . |
| 533348 | 2/1922 | France . |
| 620196 | 4/1927 | France . |
| WO80/00324 | 3/1980 | PCT Int'l Appl. . |
| 169675 | 12/1921 | United Kingdom . |
| 650363 | 2/1951 | United Kingdom . |

*Primary Examiner*—James G. Smith

*Attorney, Agent, or Firm*—Willian Brinks Olds Hofer Gilson & Lione

[57] ABSTRACT

A wrench capable of being quickly adjusted and secured in position by the sliding movement and wedging action of the movable parts of the wrench. The wrench comprises a handle portion and a head portion provided with a fixed jaw, a movable jaw carried by the head portion having an angled bottom surface, a slot formed in the head portion with a surface portion disposed in a plane oblique to the direction of movement of the movable jaw, a movable cleat carried within the slot, a guide channel formed in the head portion for slidably receiving the movable jaw, and a set of gripping plates affixed laterally to the cleat. Movement of the gripping plates cooperatively moves the cleat which in turn engages and cooperatively moves the movable jaw until the jaw secures the nut or bolt against the fixed jaw. Pressure produced by the user attempting to turn the nut or bolt tends to wedge the cleat between the bottom surface of the movable jaw and the surface portion of the slot while the oblique surfaces incorporated in the movable parts of the wrench prevent the movable jaw from opening while in use.

13 Claims, 2 Drawing Sheets

QUICK-ADJUSTING WRENCH

TECHNICAL FIELD

This invention relates to wrenches and, more particularly, to adjustable wrenches.

BACKGROUND ART

In most prior adjustable wrenches having a fixed jaw and an adjustable jaw, the adjustable jaw is adjusted and secured in position by a journaled screw which engages corresponding serrations formed on the shank of the adjustable jaw. Such wrenches are often clumsy and difficult to adjust and consume valuable time as the screw is slowly turned to move the jaw.

In addition, once the adjustable jaw has engaged the nut, the jaw often slips or loosens and loses the firm engagement with the nut or bolt as there is nothing to prevent the adjustable jaw from opening except for the user applying finger pressure on the screw to prevent it from rotating. This slippage, common to prior wrenches, inevitably strips the nut or bolt being worked on. Further, such prior tools are also costly to manufacture due to the adjusting screws used in their construction.

A prior adjustable wrench is shown in U.S. Pat. No. 1,397,214 wherein the adjustable jaw is held in varying positions by a retractable clutch. The clutch is disposed in the wrench head and has ratchet teeth formed at its outer end adapted to engage corresponding ratchet teeth formed on the shank of the adjustable jaw. The clutch is spring-biased against the jaw shank and must be retracted to move the adjustable jaw away from the fixed jaw.

The following patents are exemplary of other prior wrenches: U.S. Pat. Nos. 1,004,561; 1,427,918; 1,481,250; 1,511,536; and 1,514,017.

DISCLOSURE OF THE INVENTION

In accordance with a presently preferred embodiment of this invention, an adjustable wrench is provided capable of being adjusted quickly by movement of its movable parts and secured in position by a wedging action produced by a series of angled surfaces incorporated within the movable parts of the wrench. The wrench of this invention generally includes a handle portion at one end and a head portion at the other end, a fixed jaw formed as an integral part of the head portion, an adjustable jaw carried by the head portion, a slot formed in the head portion, a cleat slidably carried within the slot, engaging means such as gripping plates carried laterally of the head portion and attached to the cleat, and a guide channel formed in the head portion for slidably receiving the adjustable jaw. The wrench provided by this invention eliminates the common journaled worm screw used to adjust the adjustable jaw and employs instead the wedging action produced by the angled surfaces of the movable parts engaging one another to secure the adjustable jaw in position.

The adjustable jaw is provided with a lower shank having an angled bottom surface which is disposed in a plane oblique to the direction of movement of the adjustable jaw. The slot formed in the head portion has a surface portion also disposed in a plane oblique to the direction of movement of the adjustable jaw and also oblique to the bottom surface of the shank. The movable cleat is provided with an angled top surface portion and a bottom surface portion. The bottom surface of the cleat slidably travels upon the surface portion of the slot while the angled top surface portion of the cleat is adapted to engage and abut the angled bottom surface of the shank of the adjustable jaw. The gripping plates are disposed laterally of the head portion and each is affixed to opposing sides of the cleat.

In use, a user of the wrench provided by this invention moves the gripping plates in the direction toward the nut or bolt being worked upon which in turn cooperatively displaces the movable cleat, which in turn engages the bottom surface of the shank of the adjustable jaw and cooperatively displaces the adjustable jaw toward the nut or bolt. Once the nut is secured between the jaws of the wrench, the adjustable jaw is prevented from loosening and moving away from the fixed jaw, and thereby losing its firm engagement with the nut, by the series of oblique surfaces, e.g., the bottom surface of the shank, the angled top surface portion of the cleat, and the surface portion of the slot, engaging one another under pressure produced when the user attempts to turn the nut or bolt. The outward pressure produced when attempting to turn the nut or bolt acts to increase the wedging action of the cleat between the bottom surface of the shank of the adjustable jaw and the surface portion of the slot, thereby preventing the adjustable jaw from opening.

To release the adjustable jaw, the user moves the gripping plates in the direction away from the fixed jaw which cooperatively displaces the cleat within the slot. The plates are preferably provided with dog extensions extending transversely inwardly from the plates and which engage the shank of the adjustable jaw and cooperatively displace the adjustable jaw as the plates are moved away from the fixed jaw and disengage the wrench from the nut or bolt.

In an alternative embodiment provided by this invention, a spring may be provided connected at one end to the cleat and at the other end to the shank of the adjustable jaw so that when the cleat is displaced away from the fixed jaw by movement of the gripping plates, the spring acts to displace the adjustable jaw in the same direction thereby disengaging the wrench from the nut or bolt.

The quickly adjustable wrench provided by this invention can be adjusted to fit a nut or bolt with only a quick flip of the finger and gives the user a firm, nonsliding grip on the nut or bolt being worked upon.

BEST MODE FOR CARRYING OUT THE INVENTION

Figure 1:
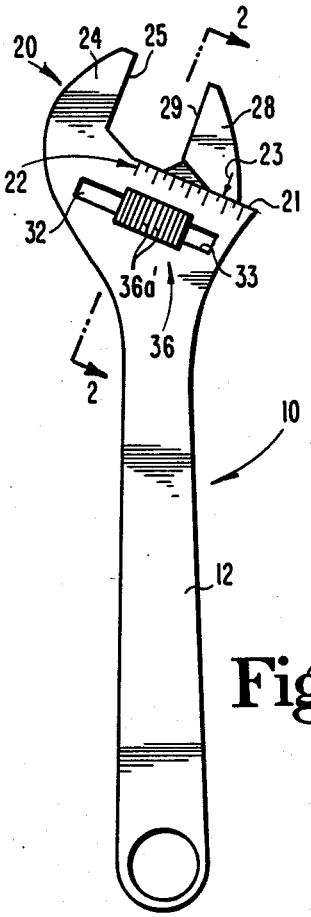
FIG. 1 is a side elevation of a wrench embodying this invention.
Figure 2:
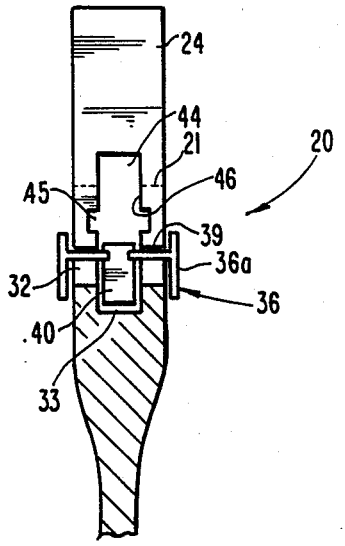
FIG. 2 is a cross-sectional view of the head portion of the wrench of FIG. 1 embodying this invention taken at of line 2—2 of FIG. 1.

An adjustable wrench 10 in accordance with the presently preferred embodiment of this invention is shown in FIGS. 1 and 2 as including a handle portion 12 and a head portion 20 formed at one end of the handle portion provided with a fixed jaw 24, an adjustable jaw 28, a slot 32 formed in head portion 20, gripping plates 36, cleat or wedge 40, and guide channel 44 formed in head portion 20 for slidably receiving adjustable jaw 28. For purposes of illustration, adjustable jaw 28 is not shown in FIG. 2. Fixed jaw 24 and adjustable jaw 28 project lengthwise from head portion 20 at an angle acute to the longitudinal axis of wrench handle 12. Fixed jaw 24 is formed with flat gripping face 25 disposed substantially parallel to flat gripping face 29 formed on adjustable jaw 28. If desired, gripping faces 25 and 29 may be provided with serrations or teeth formed transversely thereon to provide improved gripping action.

Guide channel 44 extends along the upper edge 21 of head portion 20 and is provided with recess portions 45 formed in side walls 46. As shown in FIG. 2, recess portions 45 are squared-out portions; however, it is to be appreciated that the recess portions may have any of a variety of shapes as long as the recess portions slidably receive adjustable jaw 28 and maintain smooth linear movement of the jaw. Slot 32 has a substantially smooth surface portion 33 disposed in a plane oblique to the direction of movement of adjustable jaw 28.

As shown in FIG. 2, gripping plates 36 are provided with dog extensions 39 which extend transversely inwardly from plates 36 at edges **36*a* which are disposed transverse to the direction of movement of cleat 40 and which, in a manner discussed below, move adjustable jaw 28 in an outwardly direction away from fixed jaw 24**.

Head portion 20 preferably bears a graduated and numbered scale 22 on its side adjacent upper edge 21, and adjustable jaw 28 is provided with an index arrow 23 for cooperation with the graduated scale. When adjustable jaw 28 firmly engages a nut or bolt and secures it against fixed jaw 24, the user may refer to the scale which will indicate the size of the nut or bolt. The scale provided directly upon the head portion of the wrench eliminates the need for a caliper to determine such dimensions.

Figure 3:
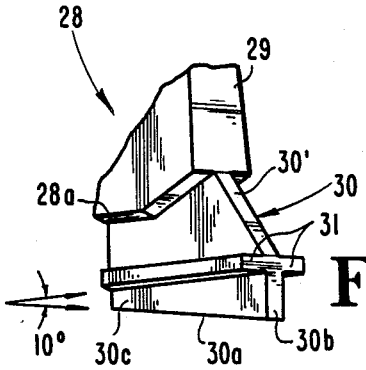
FIG. 3 is a perspective view of an adjustable jaw provided by a presently preferred embodiment of this invention.

Adjustable jaw 28 is more clearly shown in FIG. 3 as having lower shank 30 formed as an integral part thereof with tongue means 31 extending laterally outwardly from shank 30. Tongue means 31 are adapted to be received by recess portions 45 formed in the side walls 46 of the guide channel 44 and tend to stabilize and maintain the movement of adjustable jaw 28 in a continuous linear direction as the jaw reciprocably moves within guide channel 44. Adjustable jaw 28 is further provided with neck portion 30' leading to bottom surface **30*a* which is substantially smooth and disposed in a plane oblique to the direction of movement of the jaw within the guide channel. Bottom surface 30*a* is preferably angled at approximately 10° from horizontal from end 30*c* of the shank toward forward shank portion 30*b*. Neck portion 30' of the shank reciprocably moves within guide channel 44 adjacent side walls 46. Lug portion 28*a* likewise reciprocably moves along upper edge 21 of head portion 20**.

Figure 4:
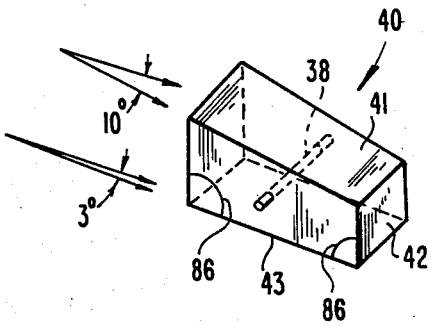
FIG. 4 is a perspective view of a cleat provided by a presently preferred embodiment of this invention.
Figure 5:
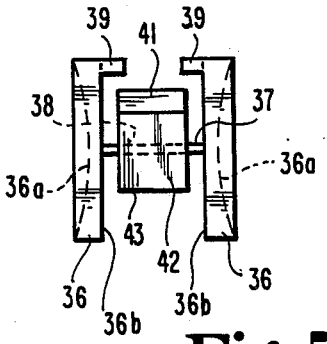
FIG. 5 is a front elevation of the cleat of FIG. 4 and a set of plates affixed thereto provided by a presently preferred embodiment of this invention.

As more clearly shown in FIGS. 4 and 5, cleat 40 is a six-sided article having angled top surface portion 41, end surface portion 42 and bottom surface portion 43, each of which is preferably substantially smooth. Bottom surface portion 43 reciprocably moves adjacent surface portion 33 of slot 32 and top surface portion 41 engages, in a manner described below, the bottom surface **30*a* of the adjustable jaw. Gripping plates 36 are affixed to cleat 40 by pin 37 which extends through bore 38 formed in cleat 40 and is welded at its ends to inner surfaces 36*b*, thereby allowing plates 36 and cleat 40 to move in cooperation. It is to be appreciated that there exists alternative methods by which plates 36 may be affixed to cleat 40 and that this invention is not limited by the particular embodiment illustrated herein. Plates 36 are preferably provided with concave surface portions 36*a* (shown in phantom lines in FIG. 5) and knurls 36*a'* (FIG. 1**) to facilitate moving the plates with the finger and to prevent the finger from slipping off the plates.

It is further to be appreciated that this invention is not limited to the embodiment wherein the gripping plates affixed to the cleat are disposed laterally of the head portion of the wrench. Several finger-engaging alternative means exist allowing a user to displace the cleat and cooperatively displace the movable jaw so as to engage a nut or bolt.

Figure 6:
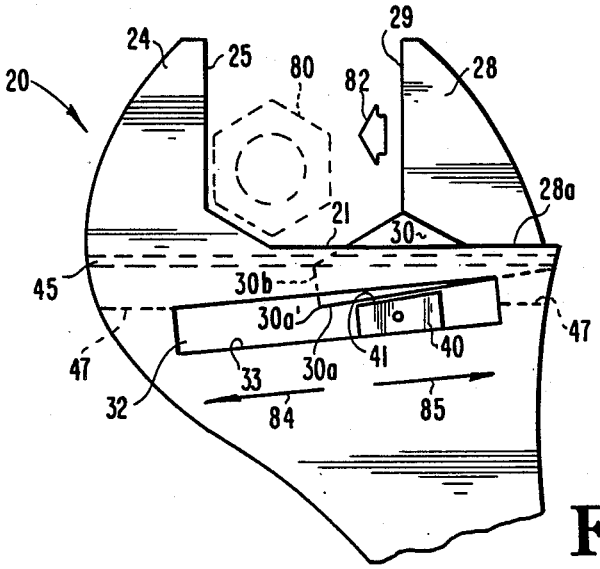
FIG. 6 is a side elevation of the head portion of the wrench of FIG. 1 embodying this invention.

The means by which adjustable jaw 28 coacts with cleat 40 to provide a quick-adjusting wrench is more clearly shown in FIG. 6 wherein an enlarged view of head portion 20 is illustrated having fixed jaw 24 and adjustable jaw 28 disposed about nut or bolt 80 (shown in phantom lines) and cleat 40 positioned within slot 32. For purposes of more clearly illustrating how the particular elements of wrench 10 interact, gripping plates 36 have been omitted. As shown in FIG. 6, adjustable jaw 28 is movable from its present open position in the direction indicated by reference arrow 82 by the user moving one of the gripping plates 36 with a finger, which in turn displaces cleat 40 in the identical direction as indicated by reference arrow 84. As cleat 40 is moved adjacent to shank 30, angled top surface portion 41 of cleat 40 engages bottom surface **30*a* of shank 30 and cooperatively displaces adjustable jaw 28 toward nut 80 until gripping face 29 engages nut 80 and secures the nut against gripping face 25 of fixed jaw 24. Once the nut is secured between the jaws of the wrench, the user may remove his finger from plates 36 as adjustable jaw 28 is prevented from loosening and moving outwardly away from the fixed jaw by the series of oblique surfaces, e.g., bottom surface 30*a* of shank 30, angled top surface portion 41 of cleat 40, and surface portion 33 of slot 32, engaging one another under outward pressure produced by the user attempting to turn nut 80. This pressure acts to wedge cleat 40 between bottom surface 30*a* and surface portion 33, thereby securing adjustable jaw 28** in position.

As discussed above, the movement of adjustable jaw 28 is maintained in a continuous linear direction as indicated by reference arrow 82 by tongue means 31 (not shown in FIG. 6) reciprocably moving within recess portions 45 (shown in phantom lines in FIG. 6) and lug portion **28*a* sliding upon upper edge 21 of the head portion 20. Guide channel 44 is provided with floor 47 maximum lowest point 30*a'* of the shank. Thus, the collective action of these elements maintains the movement of adjustable jaw 28** in a smooth linear manner.

Cleat 40 moves reciprocably within slot 32 in a likewise smooth linear manner, however, surface portion 33 of slot 32 is disposed in a plane oblique to the direction of movement of adjustable jaw 28. When adjustable jaw 28 is in engagement with nut 80, angled top surface portion 41 of cleat 40 is in frictional engagement with bottom surface 30*a* of shank 30 and the bottom surface portion 43 of the cleat is in frictional engagement with surface portion 33 of slot 32. The outward pressure on adjustable jaw 28 produced when attempting to turn nut 80 tends to wedge cleat 40 more firmly interposed between adjustable jaw 28 and surface portion 33. This wedging action prevents the slipping of the adjustable jaw which destroys the firm engagement of the wrench about nut 80.

As shown in FIG. 4, top surface portion 41 of cleat 40 is preferably angled approximately 10° from horizontal which corresponds to the angled surface of bottom surface 30*a* of shank 30, which in turn is also angled approximately 10° from horizontal. Bottom surface portion 43 of cleat 40 is preferably also formed at an angle of approximately 2°–3° from horizontal which causes angles 86 to be non-right angles. It is to be understood that it is not essential for the effective operation of this invention that cleat 40 be provided with an angled bottom surface portion 43 as effective operation may be achieved providing a bottom surface portion disposed substantially transverse to end surface portion 42 whereby angles 86 would be right angles. In accordance with surface portion 33 of slot 32 being disposed in a plane oblique to the direction of movement of adjustable jaw 28, surface portion 33 is preferably disposed on a plane approximately 2°–3° from horizontal to provide, in conjunction with bottom surface 30*a* of shank 30, the wedging action which provides the means for securing the adjustable jaw in position.

Referring now back to FIG. 6, to release adjustable jaw 28 the user, again using a finger, moves the gripping plates (not shown) in the direction away from fixed jaw 24 as indicated by reference arrow 85. As the gripping plates are moved away from the fixed jaw, cleat 40 is also cooperatively displaced and dog extensions 39 (FIG. 5), extending transversely inwardly from the plates, engage or hook forward shank portion 30*b* of shank 30 at a point slightly above point 30*a'* and cooperatively displace adjustable jaw 28 away from the nut 80 to disengage the wrench from the nut.

Figure 7:
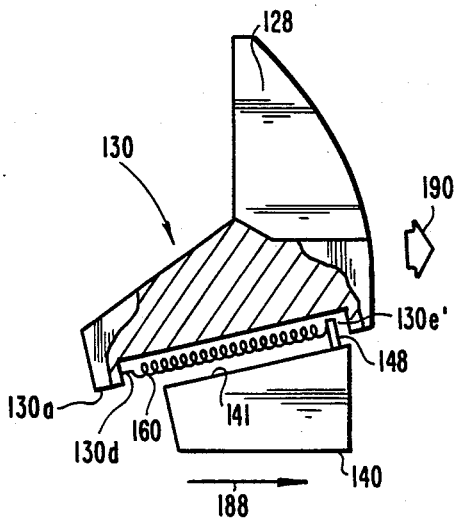
FIG. 7 is a side elevation partly in section of an adjustable jaw and a cleat of a wrench provided by an alternative embodiment of this invention.

An alternative embodiment of the means by which the adjustable jaw is retracted or moved away from the nut is shown in FIG. 7 wherein adjustable jaw 128 and movable cleat 140 are shown in isolation for purposes of clarity. The remaining parts of the alternative embodiment are identical to those disclosed herein before. In the alternative embodiment, an adjustable wrench is provided including tension spring 160 attached at one end to cleat 140 at post 148 by conventional means, and at the other end to shank 130 at hook 130*d*. By "tension" spring, it is meant a spring that is normally stretched between two points, and when released, the energy stored in the spring will cause it to contract and shorten in length as opposed to a compression spring which resists a force tending to compress it. When cleat 140 is moved in the direction indicated by reference arrow 188 by the user using his finger to move the gripping plate, spring 160 acts to tow or draw adjustable jaw 128 in the same direction and the jaw opens or moves away from the fixed jaw as indicated by reference arrow 190. Spring 160 is intended to extend longitudinally within cavity 130*e* formed in bottom surface 130*a* of shank 130. It is to be understood that the width of cavity 130*e* must be less than the width of angled top surface portion 141 of cleat 140 so as to allow bottom surface 130*a* to engage and abut angled top surface portion 141 to wedge the cleat 140 between the adjustable jaw and the surface portion of the transverse slot and prevent adjustable jaw 128 from opening.

It is not essential to the effective operation of this alternative embodiment that spring 160 be disposed as shown in FIG. 7. It will be appreciated that the spring may be attached at other points of the respective parts to perform the similar function of moving adjustable jaw 28 outwardly and away from the fixed jaw by the user moving cleat 40 in the same direction. For example, post 148 may be affixed near the left end of cleat 140, as opposed to near the right end of the cleat as shown in FIG. 7; and hook 130*d* may be disposed at the right end of cavity 130*e*, as opposed at the left end of cavity 130*e* as shown in FIG. 7, while providing a compression spring connected therebetween so that as cleat 140 is moved outwardly in the direction of reference arrow 188, the spring will resist the force tending to compress it and push the adjustable jaw outwardly before it and away from the fixed jaw.

As shown above, the wrench provided by this invention can be adjusted about a nut or bolt, or any object, with merely a quick flip of the finger. The adjustable jaw locks tight against the object due to the wedging action effected by the series of oblique angles incorporated within the movable parts of the wrench. This invention is especially advantageous when working on an object around a corner which the user may not be able to see the nut but can feel it. Working in the "blind" is made easier by the quick-adjusting capability of the wrench provided by this invention. In addition, the prevention of slippage saves the edges of the nut from inevitably becoming stripped and also lessens the hand fatigue of the user caused by continuously readjusting the conventional non-locking adjustable wrenches. The lessening of hand fatigue makes the wrench provided by this invention even more attractive to frequency users of such wrenches or users of heavier adjustable wrenches user, for example, on pipe fittings and the like.

The simple design of the wrench provided by this invention allows it to be produced an assembled at a cost approximately equal to or even less than the cost of manufacture for the conventional crescent-type wrench. The wrench is provided by a forging process which provides it strength allowing it to be used for long periods of time, even under rugged use. Having few parts, the wrench is easy to clean by merely flushing it with a cleaning agent or water. The gradruate scale appearing on the side of the head portion of the wrench allows the wrench to be used as a caliper to measure the size of a nut of bolt, thus eliminating the need for the user to tote a caliper.

Although preferred embodiments have been described above, it should be recognized that the invention may take other specific forms. Because the invention can take other forms, the invention is limited only insofar as is required by the scope of the following claims.

We claim:

1. A wrench comprising:

a handle portion and a head portion formed at one end of said handle portion, said head portion having a fixed jaw with a gripping face projecting outwardly from said head portion, a guide channel formed in said head portion, and a slot formed in said head portion in communication with said guide channel;

an adjustable jaw having a shank which is adapted to slidably be received by said guide channel and move reciprocably therewithin and a gripping face disposed substantially parallel to the gripping face of said fixed jaw, said shank having an angled bottom surface oblique to the direction of movement of the adjustable jaw;

a cleat slidably carried within said slot between said adjustable jaw and head portion and having a top surface and a bottom surface with a side exposed at the slot formed in said head portion, said top surface being disposed in a plane oblique to the direction of movement of the cleat within said slot and oblique to the direction of movement of the adjustable jaw, said slot having a surface portion disposed in a plane oblique to the direction of movement of said adjustable jaw and oblique to the angled bottom surface of said shank, said cleat being adapted to slidably move within said slot; and means adapted to be engaged by the user extending outwardly from within said slot, said engaging means being affixed to said cleat, said adjustable jaw being adapted to be moved toward said fixed jaw so as to engage a nut or bolt by movement of said engaging means toward said nut or bolt until the gripping faces of said adjustable jaw and of said fixed jaw engagably abut said nut or bolt, said cleat being cooperatively displaced within said slot by the movement of said engaging means until the oblique top surface of said cleat engages the oblique bottom surface of said shank and the bottom surface of the cleat engages the oblique surface portion of the slot so as to prevent movement of said adjustable jaw in a direction away from said fixed jaw.

2. The wrench as in claim 1 wherein said guide channel is provided with side walls, each having a recess portion formed therein, and said shank is provided with tongue means extending transversely outwardly from said shank, said tongue means being adapted to be slidably received by said recess portions formed in the side walls of said guide channel.

3. The wrench as in claim 1 wherein the angled bottom surface of said shank, the surface portion of said slot, the top surface and the bottom surface of said cleat are each substantially smooth.

4. The wrench as in claim 1 wherein said engaging means comprises at least one finger-engaging plate disposed laterally of the head portion, said plate having at least one edge transverse to the direction of movement of said cleat and an outer surface portion.

5. The wrench as in claim 4 wherein said shank is provided with a substantially vertical forward surface portion and said at least one plate is provided with a dog extension extending transversely inwardly from the transverse edge of said plate, said dog extension being adapted to engage the forward surface portion of the shank of said adjustable jaw as the plate and the cleat move cooperatively away from said fixed jaw within said slot and cooperatively displace said adjustable jaw away from said fixed jaw.

6. The wrench as in claim 4 wherein the outer surface of said at least one finger-engaging plate has a substantially concave contour being adapted to receive the finger of a user.

7. The wrench as in claim 4 wherein the outer surface of said at least at least one finger-engaging plate is provided with a plurality of knurls formed thereon.

8. The wrench as in claim 1 wherein said head portion bears indicia thereon and said adjustable jaw is provided with an index mark for cooperation with said indicia whereby said indicia and said reference mark collectively indicate the size of the nut or bolt when said jaws tandemly engage the nut or bolt.

9. The wrench as in claim 8 wherein said indicia comprises a graduated and numbered scale.

10. The wrench as in claim 1 wherein the gripping face of said fixed jaw and of said adjustable jaw is substantially flat.

11. The wrench as in claim 1 wherein the gripping faces of said fixed jaw and of said adjustable jaw have serrations formed transversely thereon.

12. The wrench as in claim 1 further comprising a spring being attached at one end to said cleat and at the other end to said adjustable jaw, said spring being adapted to displace said adjustable jaw away from said fixed jaw as said cleat is moved away from said fixed jaw.

13. A quickly adjustable wrench comprising:

a handle having an enlarged head portion formed at one end;

a fixed jaw projecting lengthwise and outwardly from said end portion at an angle acute to the longitudinal axis of said handle, said fixed jaw provided with a flat gripping face;

a guide channel formed in said head portion having side walls and a recess portion formed in each said side wall, said recess portions extending the length of said guide channel;

a movable jaw slidably carried by said head portion and projecting lengthwise and outwardly from said head portion at an angle acute to the longitudinal axis of said handle, said movable jaw having a shank being adapted to slidably reciprocate within said guide channel and a flat gripping face disposed substantially parallel to the gripping face of said fixed jaw, said shank having a substantially vertical forward surface portion, a neck portion adjacent said forward surface, a bottom surface, and at least one tongue member extending laterally of said neck portion and being adapted to slidably reciprocate within said recess portion formed in said side walls of said guide channel, the bottom surface of said shank being a substantially smooth angled surface disposed in a plane oblique to the direction of the movement of said movable jaw;

a slot formed in said head portion disposed in communication with said guide channel, said slot having a substantially smooth surface portion disposed in a plane oblique to the direction of movement of said movable jaw;

a slidable wedge confined within said slot with its sides exposed at opposite sides of the head portion and being adapted to move reciprocably within said slot, said wedge having a top surface and a bottom surface, each being substantially smooth, said top surface being disposed in a plane oblique to the direction of the movement of said movable jaw and further oblique to the surface portion of said slot, said bottom surface of said wedge being adapted to more reciprocably adjacent the surface portion of said slot; and a pair of gripping plates, one of said plates being affixed to one of the exposed sides of said movable wedge and the other of said plates being affixed to the opposite exposed side of said movable wedge, each of said pair of gripping plates having a forward edge disposed transversely to the direction of movement of said cleat and nearest said fixed jaw, a dog extending transversely inwardly from said forward edge, and an outer surface having a concave contour, said dog being adapted to engage the substantially vertical forward surface portion of the shank of said movable jaw when said pair of gripping plates and said wedge move in cooperation away from said fixed jaw within said transverse slot thereby sliding said movable jaw away from said fixed jaw, said movable jaw being adapted to be moved toward a nut or bolt by sliding one of said pair of gripping plates toward said nut or bolt which in turn cooperatively slides said wedge within said transverse slot, which in turn engages the bottom surface of the shank of said movable jaw and cooperatively moves said movable jaw toward said fixed jaw until the gripping faces of said jaws abut the nut or bolt on opposite sides, said wedge being firmly interposed between the angled bottom surface of the shank of the movable jaw and whereby the oblique surface portion of the slot and pressure produced by the user attempting to turn the nut or bolt increases the firm engagement of the wedge between the shank and the surface portion of the slot which secures the movable jaw in position and prevents the movable jaw from sliding in a direction away from said fixed jaw.

* * * * *

UNITED STATES PATENT AND TRADEMARK OFFICE

CERTIFICATE OF CORRECTION

PATENT NO. : 4,903,556

DATED : February 27, 1990

INVENTOR(S) : Predrag Spirov and Tom Masbaum

It is certified that error appears in the above-identified patent and that said Letters Patent is hereby corrected as shown below:

In col. 2, line 54, after "at", insert --plane--.

In col. 4, line 65, after "floor 47", insert --(shown in phantom lines) to provide clearance for the--.

In col. 6, line 44, delete "user" and insert therefor --used--; line 46, delete "an" and insert therefor --and--; line 49, delete "provided" and insert therefor --produced--; line 53, delete "gradruate" and insert therefor --graduate-- and line 56, delete "of" (second occurrence) and insert therefor --or--.

Signed and Sealed this

Sixteenth Day of April, 1991

*Attest:*

HARRY F. MANBECK, JR.

*Attesting Officer*

*Commissioner of Patents and Trademarks*